US006899241B2

(12) United States Patent
Tanaka

(10) Patent No.: US 6,899,241 B2
(45) Date of Patent: May 31, 2005

(54) WASTE COLLECTING BOX

(75) Inventor: Teruo Tanaka, Sayama (JP)

(73) Assignee: Ai. Kankyo Co., Ltd., Saitama (JP)

( * ) Notice: Subject to any disclaimer, the term of this patent is extended or adjusted under 35 U.S.C. 154(b) by 112 days.

(21) Appl. No.: 10/360,063

(22) Filed: Feb. 6, 2003

(65) Prior Publication Data

US 2004/0004078 A1 Jan. 8, 2004

(30) Foreign Application Priority Data

Jul. 4, 2002 (JP) ..... 2002-195857

(51) Int. Cl.[7] ..... B65D 6/18
(52) U.S. Cl. ..... 220/6; 220/7
(58) Field of Search ..... 220/6, 7

(56) References Cited

U.S. PATENT DOCUMENTS 1,620,585 A * 3/1927 Walther ..... 220/6
2,525,838 A * 10/1950 Smith et al. ..... 220/6
3,527,340 A * 9/1970 Cipolla ..... 220/6
4,120,417 A * 10/1978 Aquino ..... 220/6
4,714,013 A * 12/1987 Telfer ..... 220/6
5,125,524 A * 6/1992 Hosoda et al. ..... 220/6
5,299,704 A * 4/1994 Thorby ..... 220/6
5,323,921 A * 6/1994 Olsson ..... 220/6
6,253,943 B1 * 7/2001 Spykerman et al. ..... 220/6

* cited by examiner

*Primary Examiner*—Joseph Man-Fu Moy
(74) *Attorney, Agent, or Firm*—Koda & Androlia

(57) ABSTRACT

A waste collecting box to be placed on the roadside that includes a rear panel, side panels and a front panel wherein each of the side panels comprises two vertical segments, i.e., posterior and anterior segments jointed rotatably to a central junction such that the two segments can be folded at the junction with the junction moving inward until the two segments overlap with each other to form a flat structure; the rear vertical end of the posterior segment of each side panel is jointed rotatably to the lateral vertical end of the rear panel; and the front vertical end of the anterior segment of each side panel is jointed rotatably to the lateral vertical end of the front panel.

8 Claims, 21 Drawing Sheets

WASTE COLLECTING BOX

BACKGROUND OF THE INVENTION

1. Technical Field of the Invention

The present invention relates to a waste collecting box to be installed at a waste depositing enclosure where general wastes from common households are deposited for later transportation.

2. Description of the Related Art

Disposal of general wastes discharged from common households consists of depositing wastes at a specified waste depositing enclosure usually implemented on the roadside at a predetermined time on a predetermined day of the week, so that a waste transporting truck gathers the wastes, and transfers them to an incinerating plant where the wastes are incinerated to ash.

The waste depositing enclosures are spaces usually formed on the roadside as mentioned above which are specifically assigned for depositing wastes, and some of them are equipped with waste collecting boxes to prevent wastes deposited there from being dispersed, and to indicate that they are the spaces for depositing wastes. The conventional waste collecting box has various types: some of them take the form of a van-like container which has closed walls with one side-wall having a door through which wastes can be hauled into or drawn out of the container, and others of a pen-like container which has only its top surface opened. These waste collecting boxes, once installed, are permanently placed at the same waste depositing enclosures.

These waste collecting boxes come to have an increasingly large capacity partly because the amount of waste discharged from each household has risen considerably in recent years, and the larger box among them has a considerable capacity, for example, of a depth of 1–2 m, and a width (i.e., the length of the longest side) of 2–3 m, with the height being kept the same with the previous one.

Despite that collection of wastes for a given waste depositing enclosure occurs during a specified period of a specified day of the week, the waste collecting box is permanently placed on the side of a roadway or passageway. The box may occupy such a large space with respect to the width of the way that its front surface markedly protrudes towards the center of the way. In worst cases, such boxes may appear successively on both sides of a road at comparatively short intervals, to act as a permanent obstacle to interfere with the smooth passage of passengers and motor vehicles using the road which may result in traffic accidents.

In addition, since the box is permanently kept on the roadside, the likelihood of waste being hauled into the box at a time outside the specified period or on a day different from the specified day, is considerable. Indeed, the enclosure equipped with a box often becomes so dirty as a result of littered trash carelessly hauled towards the box that it disgraces the scenery of the local area.

SUMMARY OF THE INVENTION

The object of the present invention is to provide a waste collecting box easy for handling because of its being folded and unfolded through simple one-touch operations, and free from the problems encountered with the conventional box: it will not protrude markedly towards the center of a road after the collection of wastes even when the box is kept on the side of a narrow road, provided that it is properly folded; it will not disturb the passage of passengers and motor vehicles provided that it is kept folded when not in use; and it is sufficiently good in appearance when folded not to disgrace the scenery of the surrounding area.

To achieve the above object, the first feature of the present invention is essentially represented by a waste collecting box to be placed on the roadside comprising a rear panel, side panels and a front panel wherein each of the side panels comprises two vertical segments, i.e., posterior and anterior segments joined rotatably to each other via a central junction such that the two segments can be folded at the junction with the junction moving inward until the two segments overlap with each other to form a flat folded structure; the rear vertical end of the posterior segment of each side panel is jointed rotatably to the lateral vertical end of the rear panel; and the front vertical end of the anterior segment of each side panel is jointed rotatably to the lateral vertical end of the front panel. The second feature is essentially represented by that the rear panel and the front panel are linked at their centers with a supporting arm which is freely flexible at its center.

The third feature is essentially represented by that each of the rear and front panels has, at least close to both lateral ends and at the center of its top edge, frame-shaped prop members standing upright to support, when a protective net is applied over the box, the net such that the net can cover the box on the upper portions of its rear, side and front surfaces.

The fourth feature is essentially represented by that an inverted U-shaped gate-like scaffold configured to receive the rear panel within its boundaries is stabilized on the roadside, and the rear panel is securely fixed to the scaffold. The fifth feature is essentially represented by the scaffold having a rack for holding flower pots and sign boards.

The sixth feature is essentially represented by that fishing threads are attached to the scaffold and protective net. The seventh feature is essentially represented by that a hook with a protective mechanism is attached to one leg of the scaffold to hang cleaning devices therefrom.

The eighth feature is essentially represented by that a handle is attached to the top of a prop member located at the center of the top edge of the front panel.

The ninth feature is essentially represented by that cords are freely attached between the prop members or removed therefrom.

The present invention provides a waste collecting box comprising a rear panel, side panels and a front panel wherein each of the side panels comprises two vertical segments, i.e., posterior and anterior segments joined rotatably to each other via a central junction such that the two segments can be folded at the junction with the junction moving inward until the two segments overlap with each other, at which time the rear surface of the posterior segment being brought into contact with the front surface of the rear panel while the front surface of the anterior segment being brought into contact with the rear surface of the front panel, and then the three panels overlap one over another to form a flat layered structure. Provided that the box is kept folded as described above when not in use, it will not protrude markedly towards the center of a road even when the box is kept on the side of a narrow road, and thus it will not disturb the passage of passengers and motor vehicles along the road. For turning the folded state of the box into the extended state prior to use, it is only necessary to pull the side panels forward by hand. When removal or transportation of the box is required, since the two vertical segments constituting each side panel can be freely separated, they may be separated in advance. This will facilitate later transportation and installment of the box to and at a new site.

The invention ensures, in addition to the aforementioned advantage, an advantage that overlapping the rear panel, side panels and front panel one over another to form a flat structure and unfolding those panels to form a cubic box are easily achieved by simply raising by hand the centrally located supporting arm or lowering the same.

The invention ensures an advantage that covering the box on its upper portions of the rear, front and lateral surfaces with the protective net while wastes are kept deposited in the box before they are collected, can prevent the wastes from being inadvertently consumed or littered by animals such as crows, cats, etc. In addition, because the net is supported taut by props standing upright on the panels, the waste collector can easily collect wastes inside by only raising the front edge of the net by hand to make a space large enough to pull the wastes out from the box. When it is required to fold the net on completion of the collection of wastes, the box keeper can fold the net while leaving the net attached to the box, which dispenses with the need for separation of the net from the box which would be otherwise required each time the box is folded or unfolded.

The invention ensures, in addition to the above advantages, an advantage that installment of the box is quite easy because it consists of stabilizing the inverted U-shaped, gate-like scaffold on a specified site, and of fixing the rear panel to the scaffold. In addition, although the box has a sufficient flexibility because it comprises the rear, side and front panels joined together via joints, it has a sufficiently firm strength because the rear panel is supported by the rigid scaffold. When the panels are folded flat, they are held within the space defined by the scaffold, and thus they are protected from external shocks by the scaffold.

The invention ensures, in addition to the above advantages, an advantage that the box which would otherwise exert objectionable effects on the environment on account of trash often littered around it can rather emphasize the scenery of the local area by presenting graphic objects on the signboard such as patterned trees and grasses to match the environment, even while the box is left useless at long intervals on the roadside.

The invention ensures, in addition to the above advantages, an advantage that addition of fishing threads to the protective net can prevent the heedless consumption and spread of garbage by birds, particularly by crows.

The invention ensures, in addition to the above advantages, an advantage that addition of the protective mechanism to the hook for hanging cleaning devices ensures the safety of the box which would be otherwise hazardous to people because of its being installed outdoors: it prevents passers-by from being hurt as a result of the contact with the devices, or the cleaning devices from being blown away by strong wind.

The invention ensures, in addition to the above advantages, an advantage that using the handle for moving forward or backward the front panel so as to raise or lower the supporting arm at its central joint facilitates the folding and unfolding of the panels.

The invention ensures, in addition to the above advantages, an advantage that passing ropes through prop members not only prevents the entry of an unauthorized person into the box but also helps to maintain the proper shape of the protective net applied over the box.

DESCRIPTION OF THE PREFERRED EMBODIMENTS

Figure 1:
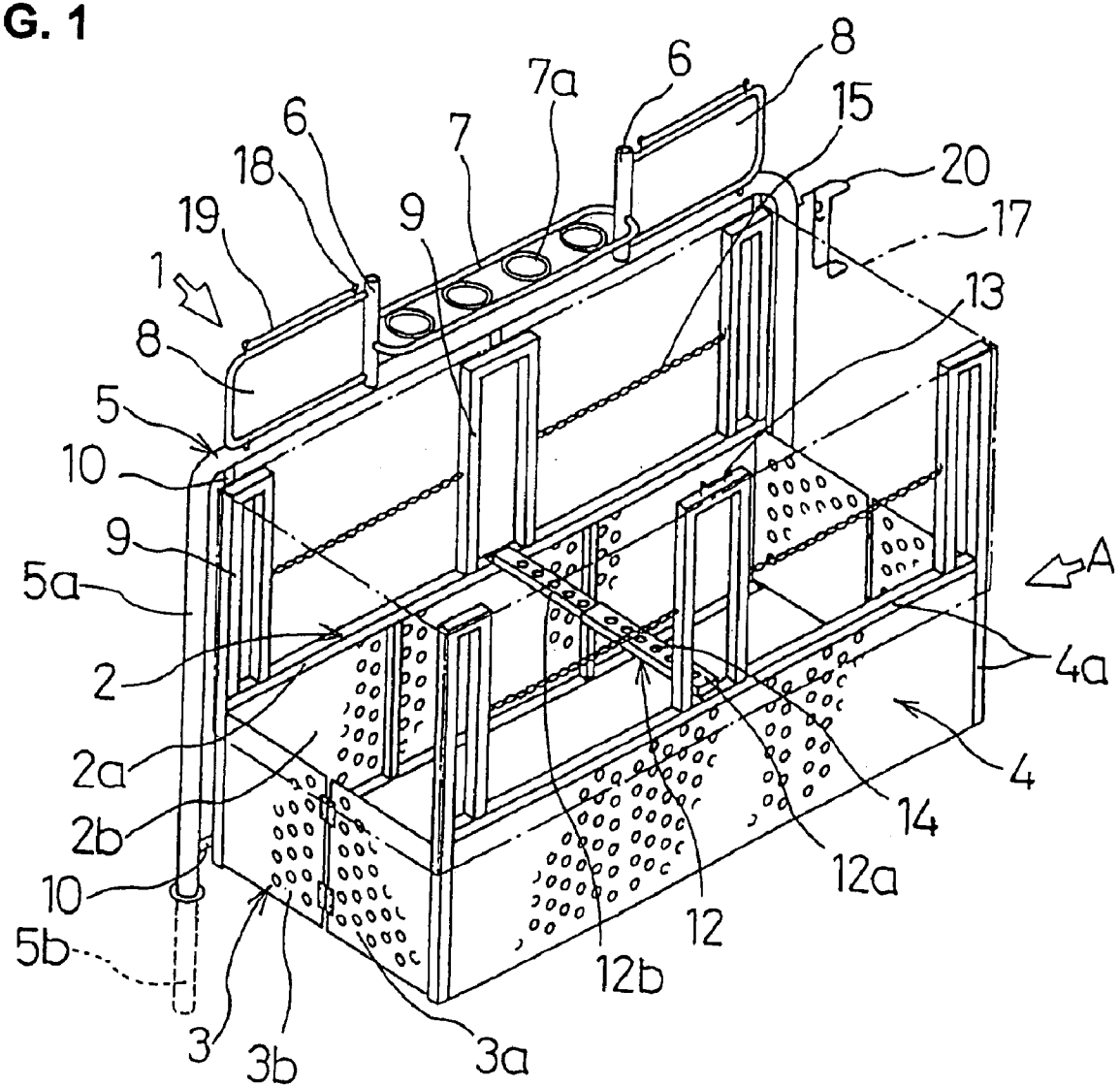
FIG. 1 is a perspective view of a waste collecting box being in an extended state embodying this invention.

The preferred embodiments of the present invention will be described below with reference to attached figures. FIG. 1 is a perspective view of a waste collecting box being in an extended state embodying this invention. The waste collecting box 1 embodying this invention comprises an enclosing member A composed of a rear panel 2, two side panels 3 and a front panel 4, and an inverted U-shaped gate-like scaffold 5 to which the rear panel 5 2 is fixed. The rear, side and front panels 2, 3 and 4 may be made from aluminum, steel or stainless steel. They are not limited to a mesh type as shown in the figure, but may take the form of a mesh, grid, weave, etc., as long as they can serve as a rigid fence.

The scaffold 5 is obtained by bending a cylindrical tube body 5*a* having a diameter of about 60 mm into an inverted U-shaped frame consisting of two legs 5*a* whose length is about 1000 mm and a bar whose length is about 1600 mm. The scaffold 5 is fixed to the ground by inserting the lower ends of its two legs into the upper ends of the two tubular piles 5*b* buried in the ground.

The bar portion of the tube body 5*a* has holes facing upward close to both ends from which two pipe-like rods 6, 6 having a height of about 270 mm stand upright. A shelf 7 for holding flower pots is placed between the two rods 6, 6. The shelf 7 is made of an oblong plate which has a series of holes 7*a* (four in the particular embodiment illustrated in the figure) formed thereupon at appropriate intervals, to receive flower pots therein. The pot holding hole 7*a* has a diameter, for example, of 100 mm.

The rods 6, 6 have sign boards 8 attached to their lateral surfaces: the sign board 8 has a height similar to that of the rod 6, that is, does not project markedly above the bar of the tube body 5*a*. The sign board may carry not only a notice or announcement of the local community, but also a guide map of the local area, advertisements of nearby shops, or graphics emphasizing the scenery of the environment such as a pattern of trees and grasses.

Figure 3:
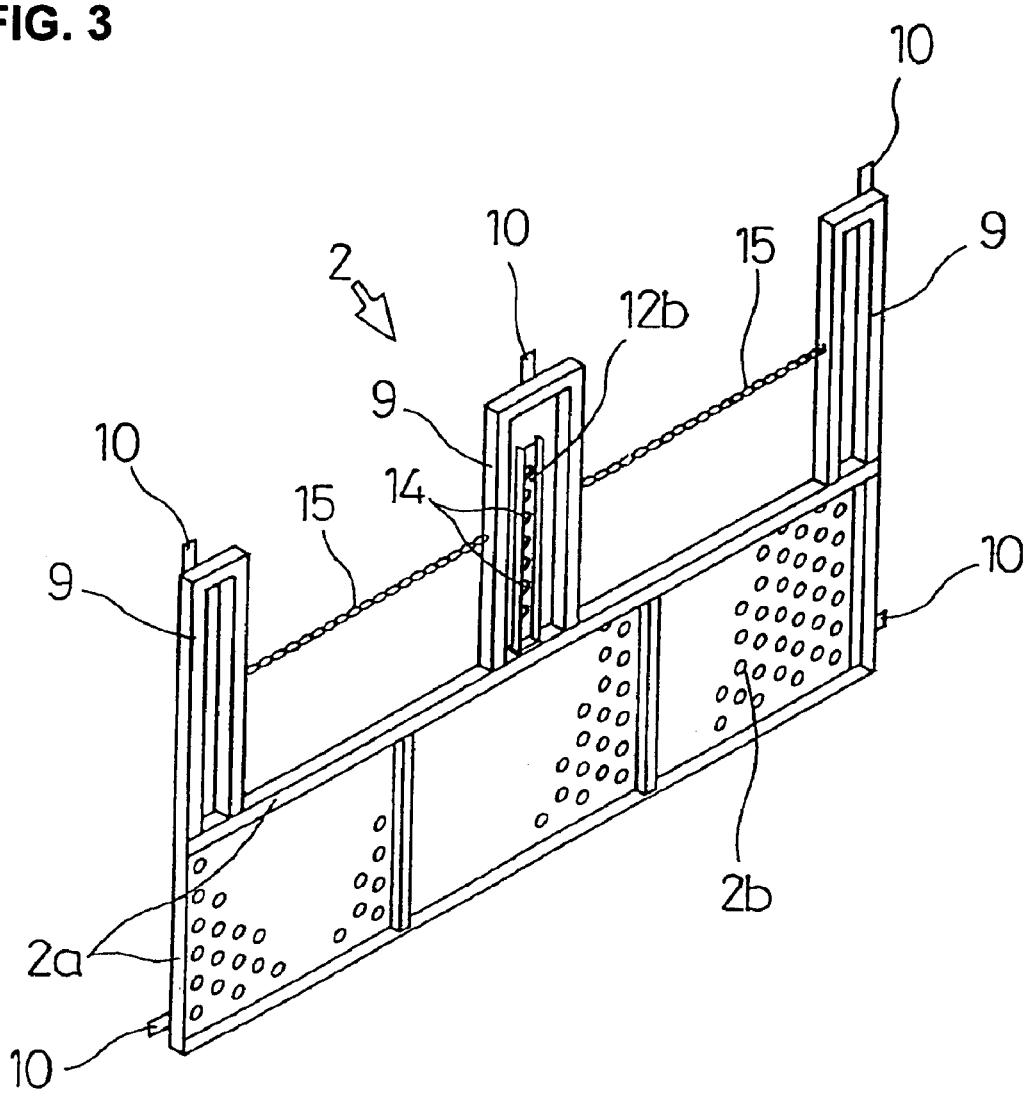
FIG. 3 is a perspective view of a rear panel presented as a part of interest of the waste collecting box embodying this invention.

The enclosing member A comprises the rear panel 2, side panels 3 and front panel 4 as mentioned above. The rear panel 2 and the front panel 4 are basically similar in their structure. Therefore, only the rear panel 2 will be described below with reference to FIG. 3.

The rear panel 2 has a size sufficiently small to be kept within the space defined by the tube body Sa constituting the scaffold 5: it has a crosswise length of about 1500 mm and a height of about 440 mm. The rear panel 2 consists of a mesh body 2*b* having its periphery surrounded by a rectangular frame body 2*a*. The lateral vertical sections of the frame body 2*a* including the corners are made of L-shaped stainless steel braces.

The frame body 2*a* has, on its top bar, oblong, frame-like props 9 at least close to both lateral ends of the bar and on its center. The frame body 2*a* is fixed with respect to the tube body 5*a* of the scaffold 5 via a joining knob 10 formed on the top of each prop which is welded onto the inner surface of the tube body 5*a*.

Figure 4:
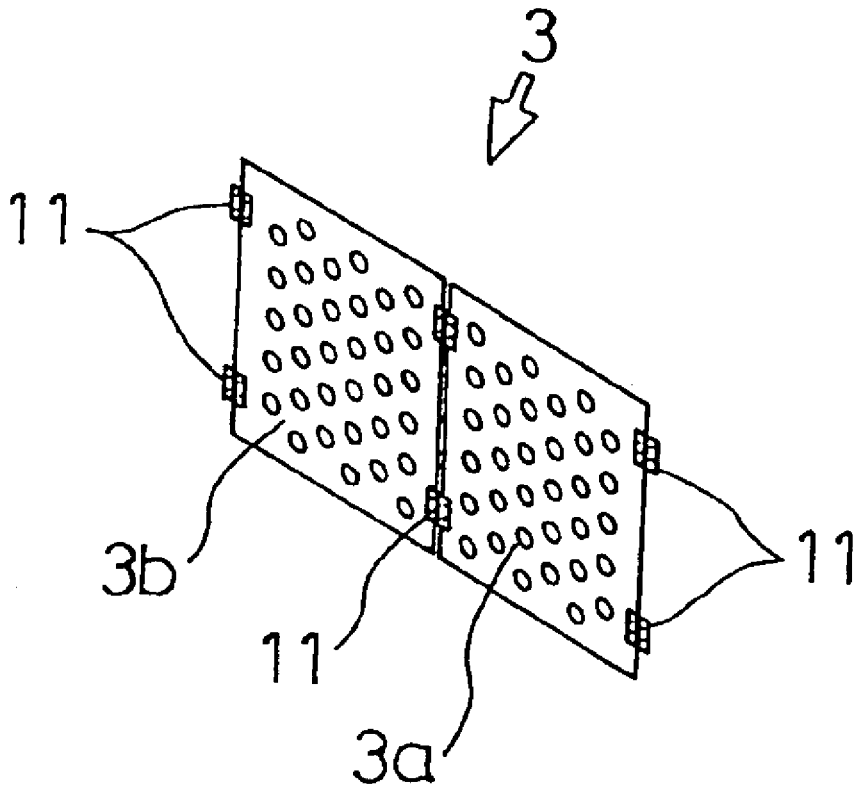
FIG. 4 is a perspective view of a side panel presented as a part of interest of the waste collecting box embodying this invention.

Each of the side panels 3 consists of two vertical segments 3*a* and 3*b* folderable at their junction as shown in FIG. 4: the anterior and posterior segments 3*a*, 3*b* are joined together with hinges 11 such that they are rotatable with respect to each other around the hinges 11. Furthermore, the posterior vertical end of the posterior segment 3*b* is jointed rotatably via hinges 11 to one side of the rear frame body 2*a*, while the anterior vertical end of the anterior segment 3*b* is jointed rotatably via hinges 11 to one side of the frontal frame body 4*a*.

The hinges 11 are placed with respect to the posterior vertical end of the posterior segment 3*b*, and to the anterior vertical end of the anterior segment 3*a* in such a manner as to permit, for inward rotation, the posterior and anterior segments 3*b*, 3*a* to rotate until the outward angle between the two segments formed at their junction is reduced to zero (the two segments overlaps with each other), but to permit, for outward rotation, the posterior and anterior segments 3*b*, 3*a* to rotate until the outward angle in question becomes 180° (the two segments form a straight line).

Each of the anterior and posterior segments 3*a*, 3*b* has the same structure as do the rear panel 2 and the front panel 4: it consists, for example, of a mesh body whose periphery is surrounded by a frame body.

The enclosing member A can be arranged to form a cubic body with the rear panel 2 and the front panel 4 being linked at their centers with a supporting arm 12 folderable at its center as shown in FIG. 1.

The supporting arm 12 comprises an anterior arm component 12*a* and a posterior arm component 12*b* which are fastened to each other and to nearby elements as follows: the frontal end of the anterior arm component 12*a* is rotatably attached to the top surface of the upper bar of the frontal frame body 4*a* enclosing the front panel 1; the rear end of the rear arm component 12*b* is rotatably attached to the top surface of the upper bar of the rear frame body 2*a* enclosing the rear panel 2; and the rear end of the anterior arm component 12*a* is rotatably fastened to the frontal end of the rear arm component 12*b*. Many holes 14 are opened through both arm components in parallel with their longitudinal axes with an appropriate interval between adjacent holes. This is for making the supporting arm 12 light.

Numeral 13 represents a handle attached to the top of a central prop 9 standing upright on the upper bar of the frontal panel 4. As described above, the frontal panel 4 has the same structure with that of the rear panel 2, but is not equipped with the joining knobs 10 as opposed to the rear panel 2.

For each of the rear and front panels 2 and 4, cords 15 such as metal chains are hanged between adjacent props 9 attached to the upper bar of the frame body. The cord 15 has its one end fixed via welding to the lateral aspect of the central prop 9 and the other end detachably fastened via a hook to the lateral aspect of a peripheral prop 9.

Figure 2:
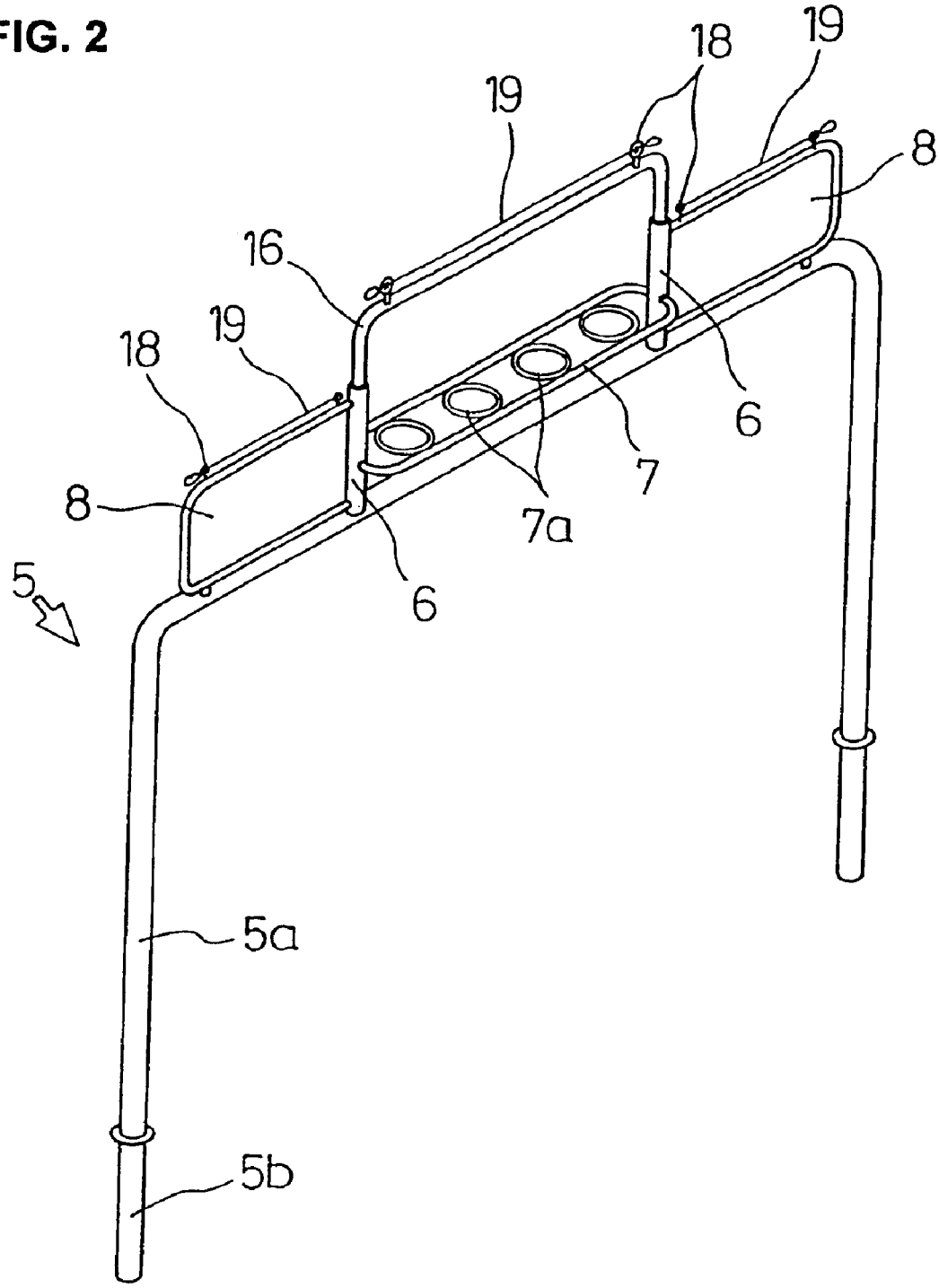
FIG. 2 is a perspective view of a supportive frame presented as a part of interest of the waste collecting box embodying this invention.

Furthermore, an inverted U-shaped beam 16 is mounted between the pipe-like rods 6, 6 as shown in FIG. 2. Mounting of the beam 16 to the rods 6, 6 is achieved by inserting its lower ends into the upper hollow ends of the pipe-like rods 6, 6.

Figure 6:
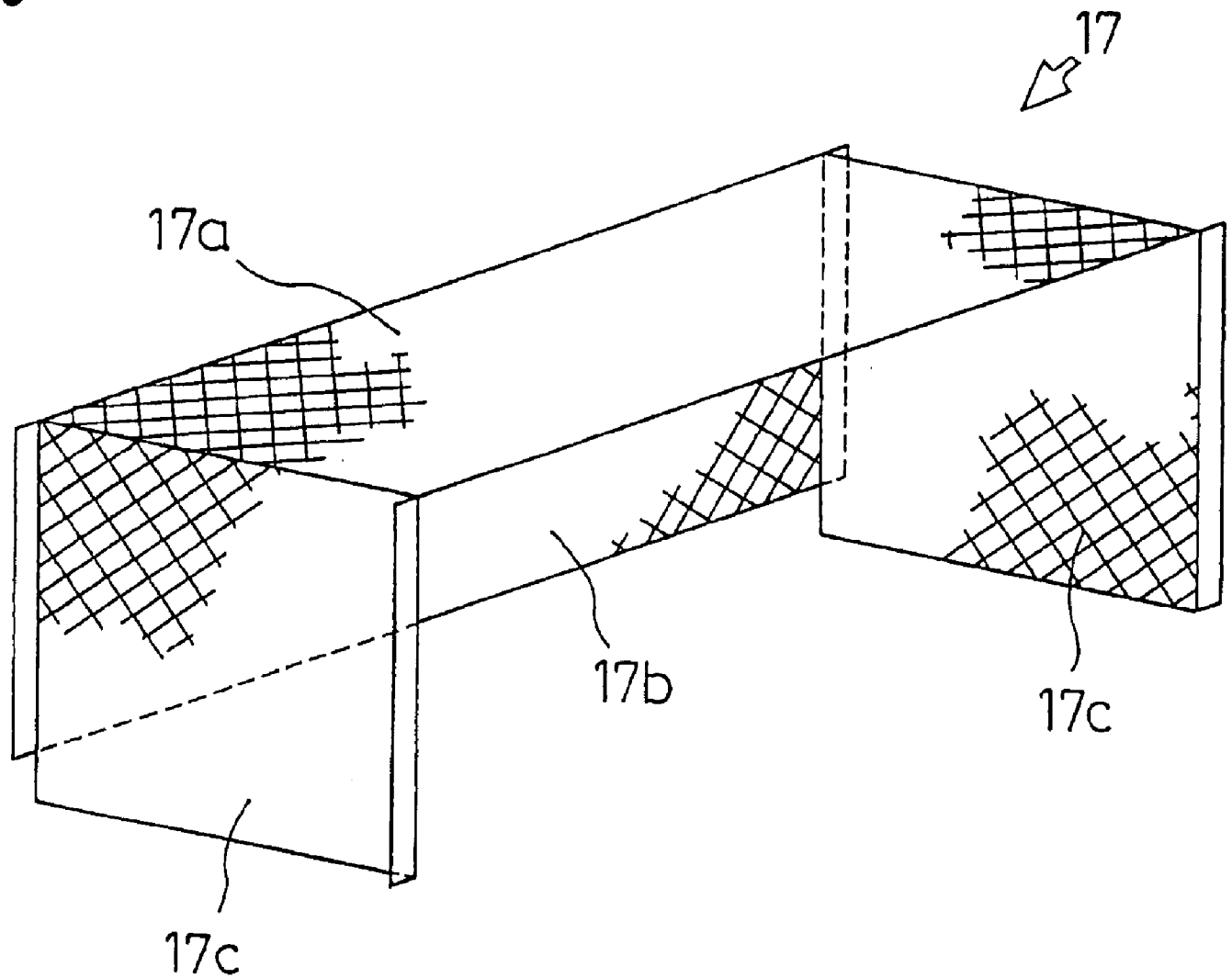
FIG. 6 is a perspective view of a protective net presented as a part of interest of the waste collecting box embodying this invention.
Figure 7:
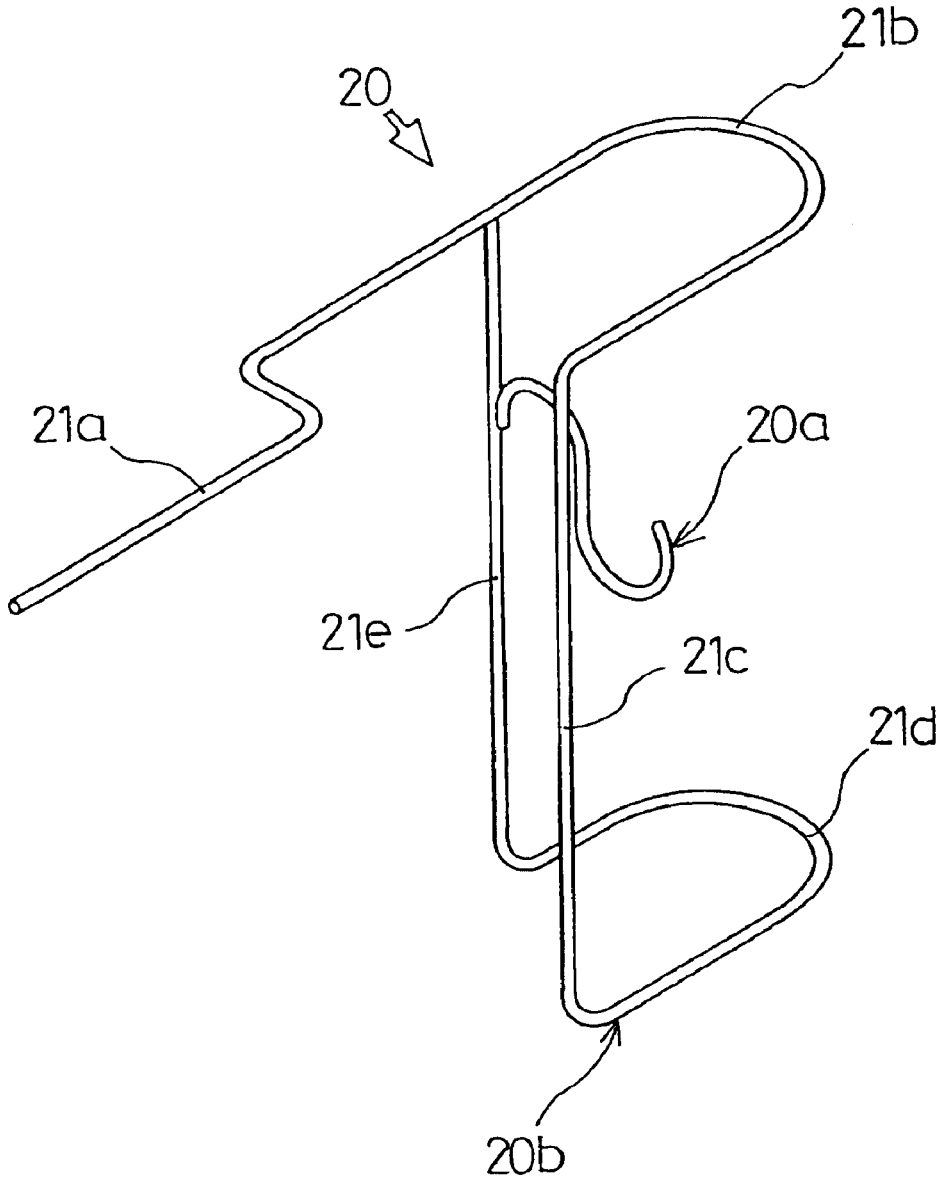
FIG. 7 is a perspective view of a hook for hanging cleaning devices presented as a part of interest of the waste collecting box embodying this invention.

Numeral 17 of FIG. 1 represents a protective net. The net covers the upper parts of the enclosing member A, while being supported by props 9. This is a box-shaped net comprising four net portions including a top portion 17*a*, frontal portion 17*b* and side portions 17*c* connected continuously together while its rear surface being kept open as shown in FIG. 6.

Hooks 18 are attached at appropriate places on the beam 16, along the frame of the sign board 8 and on the protective net 17, and fiber threads 19 (fishing thread) are fastened to those hooks.

Numeral 20 of the figure represents a hook for hanging cleaning devices. It is attached to one leg of the scaffold 5, and consists of a hook body 20*a* and a protective mechanism 20*b*. The protective mechanism 20*b* is obtained by bending a straight stainless steel rod as follows: one end of a segment 21*a* which will be attached to one leg of the tubular body 5*a* of the scaffold 5 is kept horizontal; the other free end of the segment 21*a* is horizontally bent to form a U-shaped segment 21*b*; the free end of the segment 21*b* is bent vertically downward to form a straight, vertical segment 21*c*; the free end of the segment 21*c* is horizontally bent to form a U-shaped segment 21*d*; and the free end of the segment 21*d* is bent vertically upward to form a straight, vertical segment 21*e* whose free end is welded onto the bottom surface of the U-shaped segment 21*b* at its flexion point.

Fixing the waste collecting box 1 configured as described above at a space on the side of a roadway or walkway consists of penetrating fixation holes through, for example, concrete blocks previously prepared for the purpose on the roadside, inserting the tubular piles 5*b* in those holes, and then inserting the lower ends of the tubular body 5*a* of the scaffold 5 into the upper ends of the tubular piles 5*b* for fixation. When the scaffold 5 is thus fixed, the rear panel 2, or a component constituting the enclosing member A and attached to the scaffold 5 is also fixed with respect to the roadside.

Then, the rear vertical ends of the side panels 3 are jointed via hinges 11 to the rear panel 2, and the lateral vertical ends of the front panel 4 are jointed via hinges 11 to the front vertical ends of the side panels 3. The anterior arm component 12*a* attached to the front panel 4, and the posterior arm component 12*b* attached to the rear panel 2 are fastened to each other to form the supporting arm 12 which is freely bendable at the junction between the front and rear panels 4, 2. Now, a box-like structure comprising the enclosing member A having an open top surface is assembled which maintains its form using the supporting arm 12 as a prop.

The protective net 17 is applied to cover the upper parts of the enclosing member A, being supported with props 9, and cleaning devices are hanged from the hook 20 attached to one leg of the scaffold 5. Further, flower pots are put into the holes 7*a* formed on the shelf 7 as appropriate.

Wastes are hauled from the top open space into the waste collecting box which has been assembled to take a cubic shape as described above. For hauling in waste, the waste hauler only needs to raise the frontal edge of the protective net 17 with his/her hand to open a space sufficiently large to haul in the waste therethrough. Wastes deposited in the box are collected in a waste collecting truck. For collecting wastes, the waste collector only needs to raise the frontal edge of the protective net 17 with his/her hand to open a space large enough to pull the wastes out of the box therethrough.

During the time at which wastes must be kept deposited in the box until collection of them occurs, the protective net 17 can prevent wastes from being inadvertently consumed or littered by animals such as crows, cats, etc. Particularly, fiber threads 19 (fishing threads) are effective for preventing the heedless consumption of waste by crows.

While the enclosing member A is extended, the rear panel 2, side panels 3 and front panel 4 are joined via hinges 11 to each other with small redundant spaces at their junctions, and thus the whole structure has a sufficient flexibility. Therefore, even if, for example, a child happens to heavily bump against the box, the box will be flexed so much as to absorb the shock. Thus, neither the integration of the box nor the child's body will not be seriously damaged by the shock.

Wastes littered on the roadside around the enclosure after wastes have been transferred from the box, are cleaned using the clean devices attached to the scaffold 5. The cleaning devices, when not in use, are hanged from the hook 20. While being hanged from the hook 20, the cleaning devices are kept in a space formed by the upper and lower U-shaped segments 21*b*, 21*d*. Therefore, even when wind blows hard, those devices are safely prevented from being swung heavily or flown away.

Figure 5:
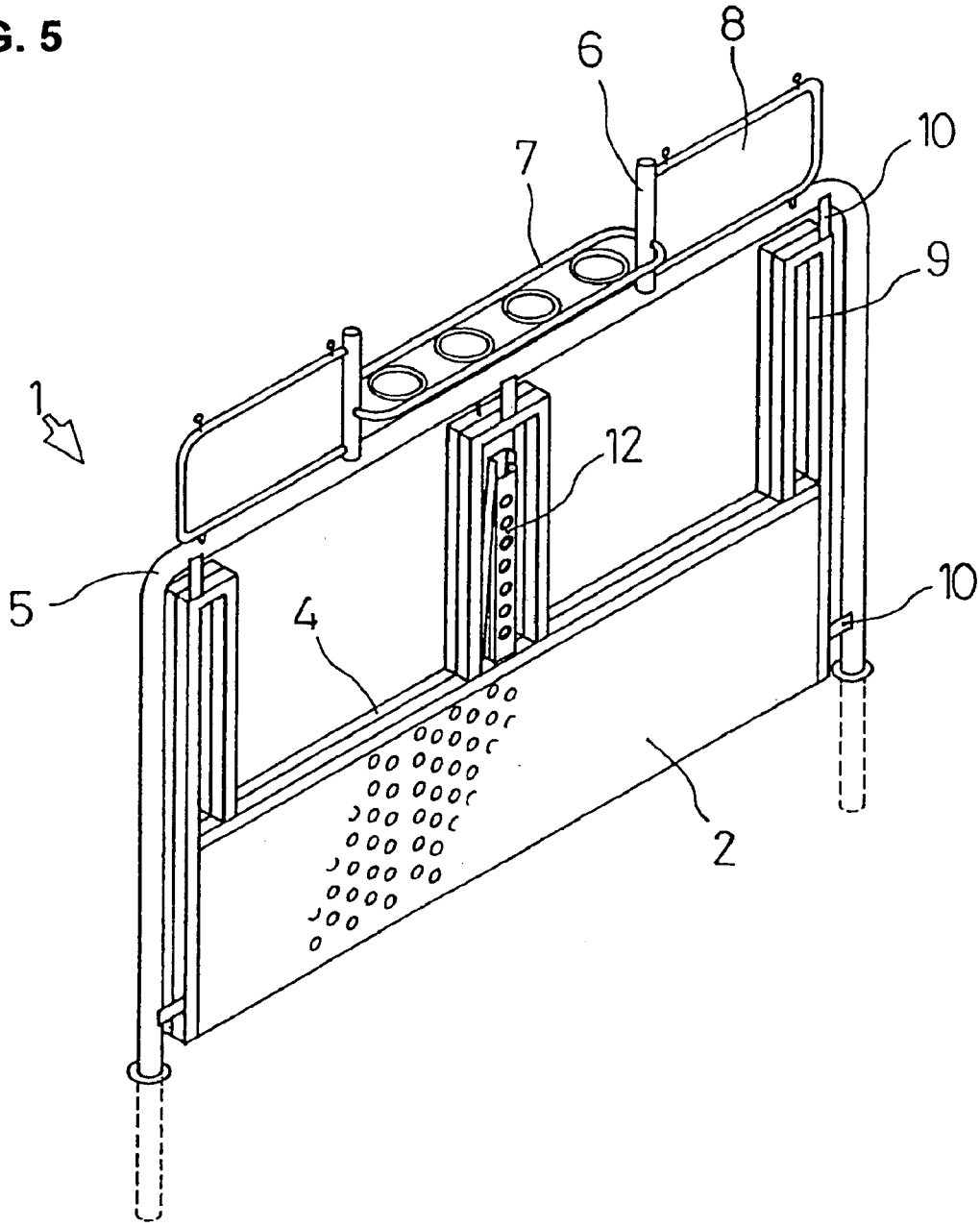
FIG. 5 is a perspective view of the waste collecting box being in a folded state embodying this invention.

When it is required to fold the enclosing member A after wastes have been transferred from the box, the box keeper holds the handle 13 by hand, and pushes the front panel 4 backward using the handle 13. Then, in the presence of the backward pressing force, both side panels 3 are flexed inward around hinges 11 at their joints to the rear and front panels, and the anterior and posterior segments 3*a*, 3*b* of each side panel 3 are folded with the central junction as a pivot. The front panel 4, being pushed backward, causes the two folded segments of each side panel 3 to overlap with each other, until the front panel 4 itself overlaps, having the folded two segments of each side panel 3 placed in between, with the rear panel 2 to form a unified flat layered structure (see FIG. 5).

During this course of events, the centrally located supporting arm 12 is also folded: the anterior arm component 12*a* and the posterior arm component 12*b* are folded with the central joint as a pivot, the pivot moving upward during folding. While the anterior and posterior arm components 12*a*, 12*b* of the supporting arm 12 are being folded, they support the approach of the frontal panel 4 towards the rear panel 2, thereby facilitating the smooth folding of the enclosing member A.

The supporting arm 12 is so light in its weight with many holes 14 formed therethrough that its arm components 12*a*, 12*b* easily flex in the presence of a pressing force. The flexion may be facilitated by an upward push applied by hand at the central joint, which will also contribute to the easy handling of the box.

In folding the enclosing member A, it is not necessary to remove the protective net 17 from it. Rather, said net 17 may be kept attached to the member A while the member A is folded.

When folded, the enclosing member A taking now a flat structure is kept within the space defined by the scaffold 5, so that it is protected against external shocks and damages.

Prior to the next round for waste collection, the box keeper holds the handle 13 by hand, and pulls forward the front panel 4 using the handle. Then, the side panels 3 are also pulled forward together with the front panel 4, with the anterior and posterior arm components 12*a*, 12*b* of the supporting arm 12 being extended until the two arm components form a straight horizontal stick, thereby enabling the smooth one-touch unfolding of the enclosing member A into the box-shaped structure.

In the above embodiment, fixing the scaffold 5 to the ground is achieved by inserting the lower ends of the legs of the scaffold body 5*a* into the tubular piles 5*b* buried in the ground, but fixation of the scaffold 5 to the ground is not limited to this method. Another method of fixing the scaffold 5 to the ground is based on the use of bolts as shown in FIGS. 8 to 16.

Figure 8:
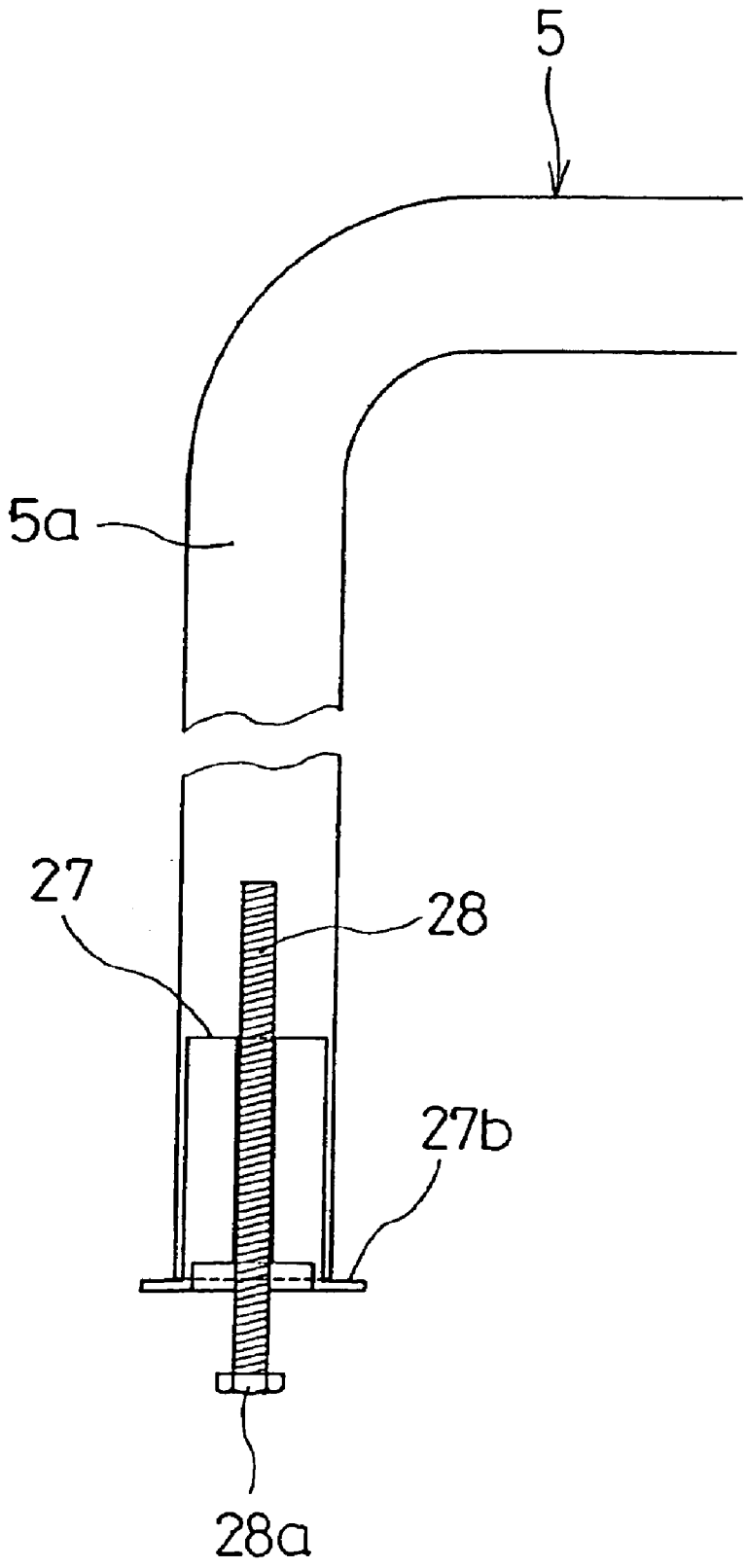
FIG. 8 is a frontal sectional view of an exemplary fixing means of the scaffold of the waste collecting box embodying this invention.
Figure 9A:
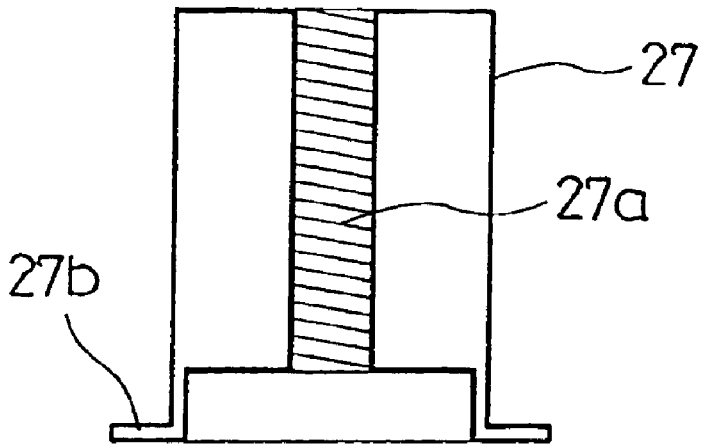
FIGS. 9(*a*) and (*b*) is a frontal sectional view of a joining metal base constituting the fixing means of the scaffold of the waste collecting box embodying this invention.
Figure 9B:
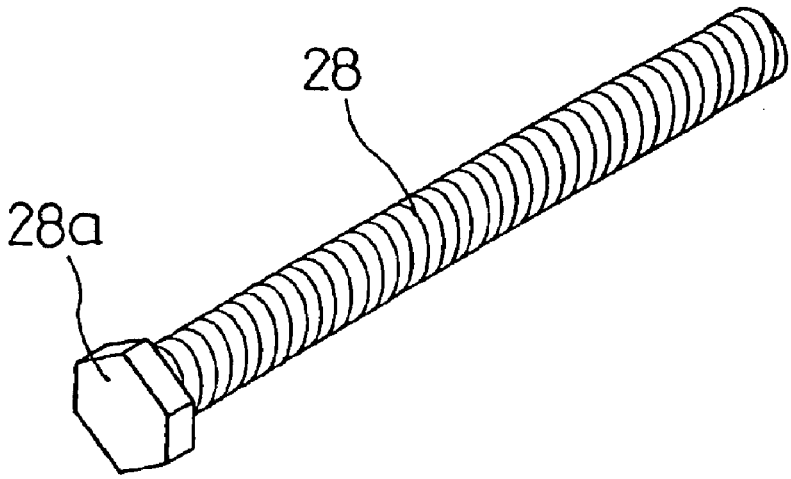

The bolt-based fixation means basically comprises a joining metal base 27 to be inserted into the lower end of a leg of the scaffold body 5*a*, and a bolt 28 having a nut 28*a* at its head as shown in FIGS. 8 and 9. The joining metal base 27 with a flange 27*b* at its distal end has a double bore structure, one larger bore at its distal end and the other smaller bore at its center which has a female thread 27*a* on its inner surface to engage with a male thread of the bolt 28.

A first exemplary method for fixing the scaffold 5 to the ground on the roadside is achieved as follows. Referring to FIG. 8, the joining metal base 27 is inserted into the lower end of a leg of the scaffold body 5*a*; and the bolt 28 is screwed into the joining metal base 27 via the engagement of the male thread with the female thread 27*a*. During insertion of the joining metal base 27 into the lower end of a leg of the scaffold body 5*a*, the flange 27*b* of the joining metal base 27 serves as a stopper to prevent the excess insertion of the joining metal base 27 into the hollow of the leg of the scaffold body 5*a*. The same operation is repeated for the other leg of the scaffold body 5*a*.

Figure 10:
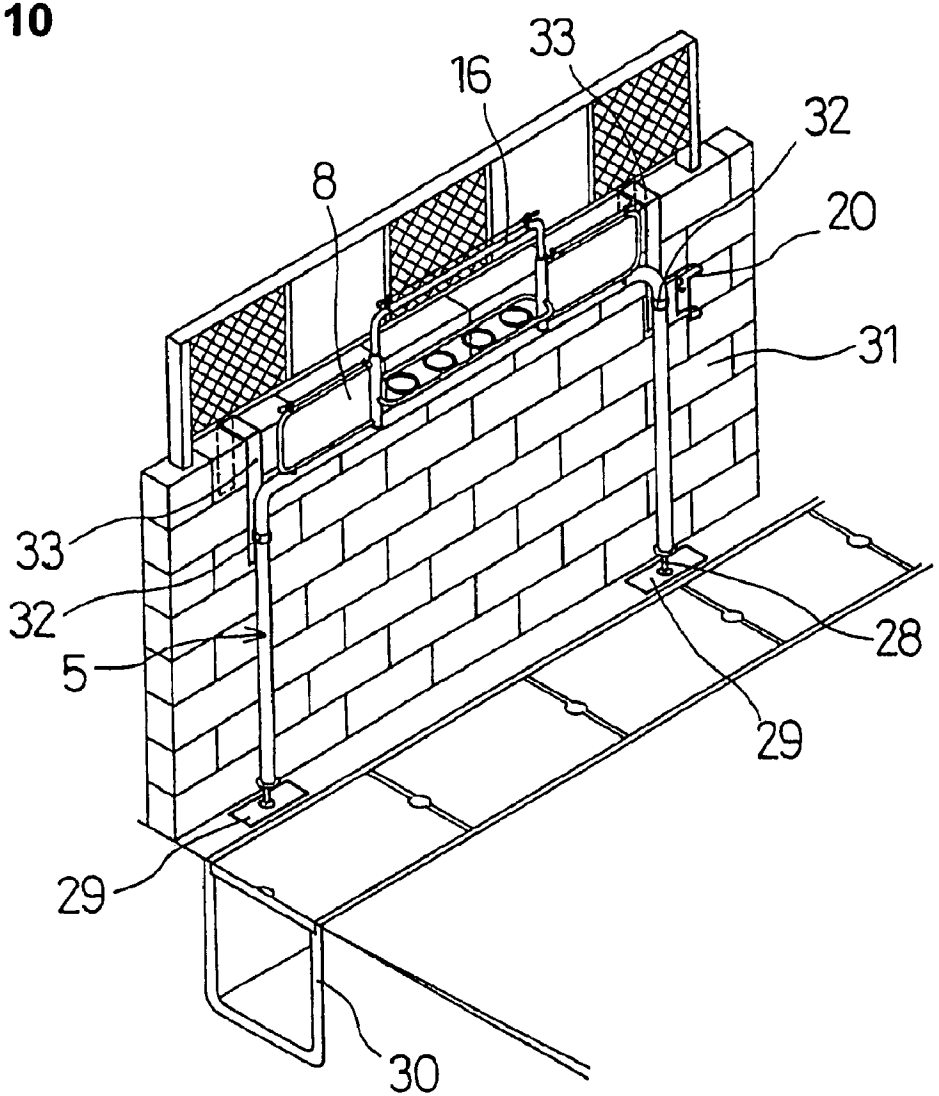
FIG. 10 is a perspective view of the scaffold of the waste collecting box embodying this invention, to show a first exemplary method for fixing the scaffold on the roadside using the fixing means.
Figure 11:
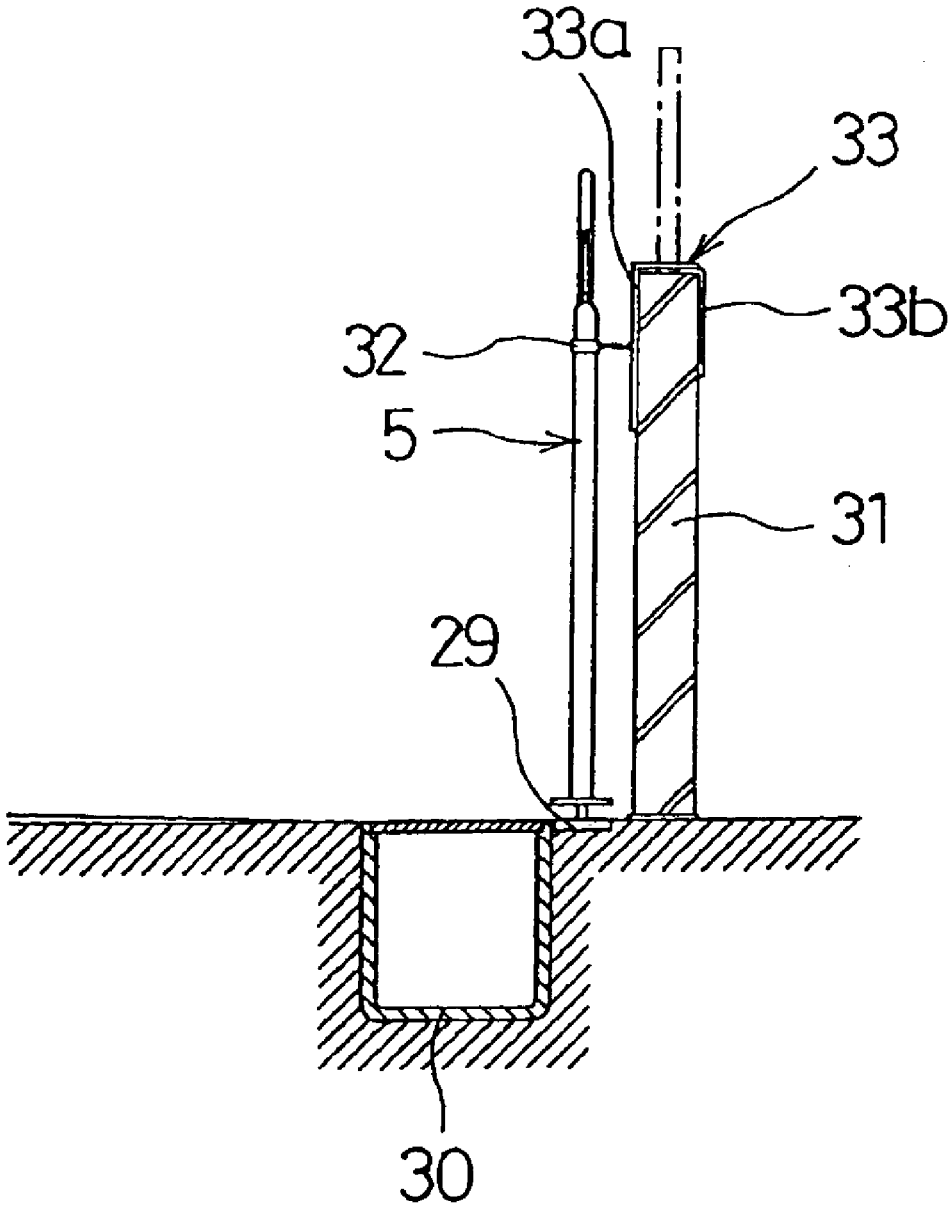
FIG. 11 is a lateral sectional view of the scaffold of the waste collecting box embodying this invention, to show the first method for fixing the scaffold on the roadside using the fixing means.
Figure 12:
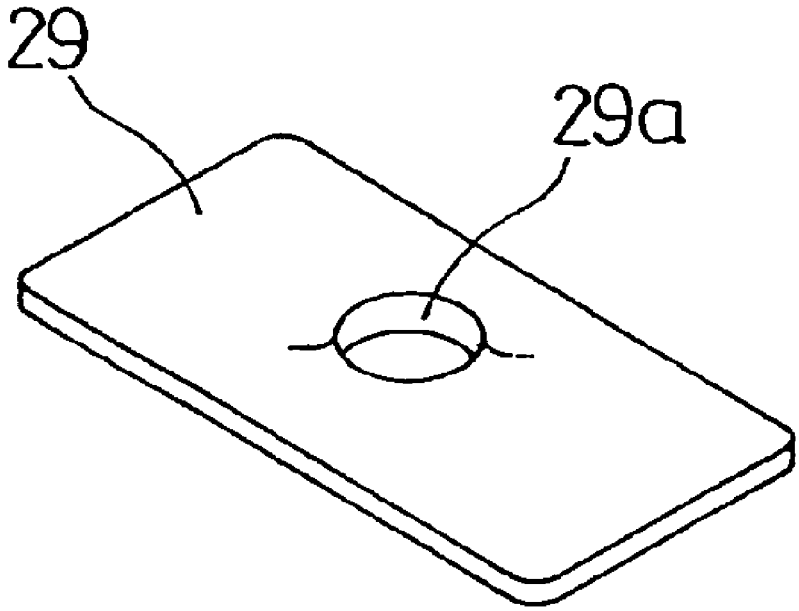
FIG. 12 is a perspective view of a planar member constituting the fixing means for the scaffold of the waste collecting box embodying this invention.

Fixation of the scaffold body 5*a* whose legs having bolts 28 attached via joining metal bases 27 to the ground on the roadside is achieved by the first exemplary method as shown in FIGS. 10 to 12. Small holes (having a depth of about 20 mm) are dug on the ground; a planar member 29 made from, for example, iron is fixed upon each hole; and the nut 28*a* attached to the head of each bolt 28 is fitted to the central hole 29*a* of the planar member 29.

The scaffold 5 is seated on the ground via bolts 28 fitted to the planar members 29. Seating the scaffold on the ground only requires spaces sufficiently wide to receive planar members 29, and thus it is possible for the scaffold 5 to be seated on a narrow space between a concrete block fence 31 and a gutter 30 on the roadside as shown in FIGS. 10 and 11.

The height of the seating scaffold 5 can be adjusted by varying the position of both nuts 28*a* with respect to the flanges 27*b*.

An exemplary second method for seating the scaffold 5 on the ground is shown in FIGS. 13 to 16. According to this method, the head of the bolt 28 is directly buried in the ground; and the lower ends of two legs of the scaffold 5 are fixed via the joining metal bases 27 to the stems of the bolts 28 protruding above the ground. According to this method, seating the scaffold on the ground only requires spaces sufficiently wide to receive the heads of bolts 28, and thus it is possible for the scaffold 5 to be seated on a narrow space between a concrete block fence 31 and a gutter 30 on the roadside.

Figure 21:
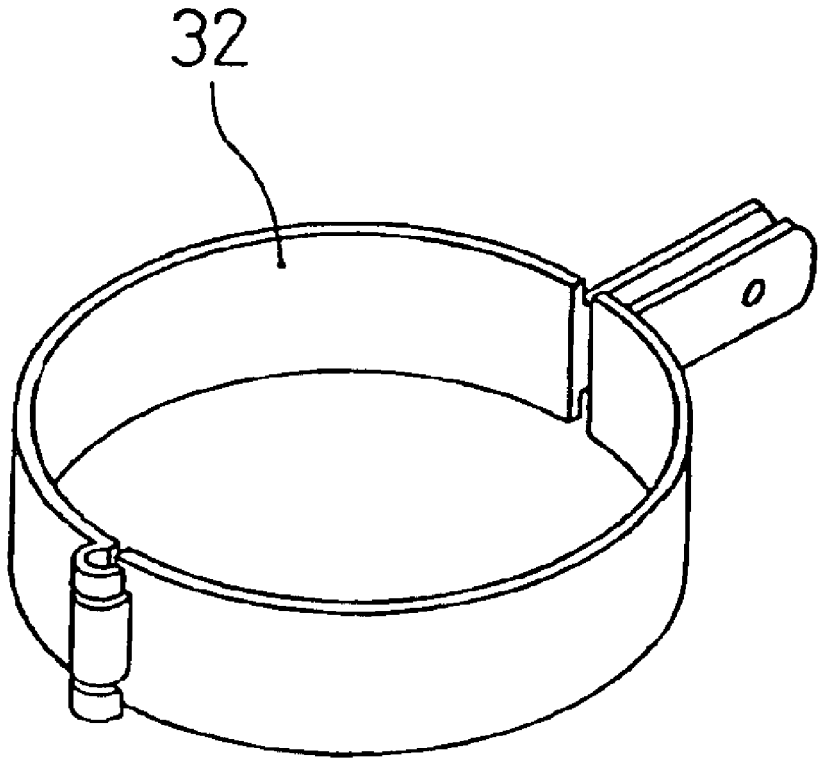
FIG. 21 is a perspective view of a metal ring fastener used in combination with the fixing means for fixing the scaffold to the ground.

Waste collecting boxes are often installed in residential areas, instead of roadsides. In such a case, a waste collecting box may be installed in front of a concrete block fence surrounding a house. Fixation of such a waste collecting box is achieved by stabilizing the box with respect to a nearby concrete block fence 31. A fixing means used for the method will be described below. A first example thereof is shown in FIGS. 10 and 11. A metal ring fastener 32 as shown in FIG. 21 is attached to the upper part of each leg of the scaffold body 5*a*; a saddle-shaped metal joining member 33 as shown in FIGS. 17 to 20 is then fitted to each ring fastener 32, and both saddle-shaped joining members 33 are mounted over the top edge of a nearby fence 31, thereby stabilizing the scaffold 5 with respect to the fence 31.

Figure 17:
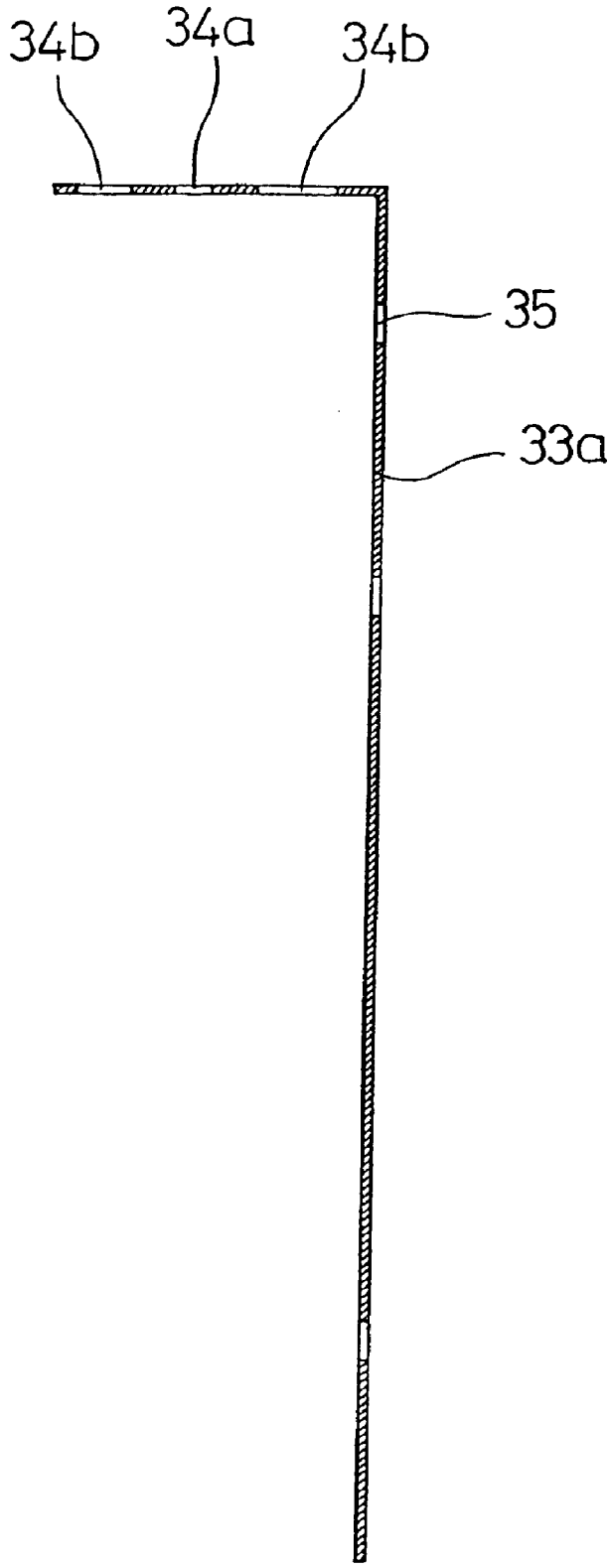
FIG. 17 is a lateral sectional view of an internal L-shaped segment, one component of a saddle-shaped joining metal member used in combination with the fixing means for fixing the scaffold to the ground.
Figure 18:
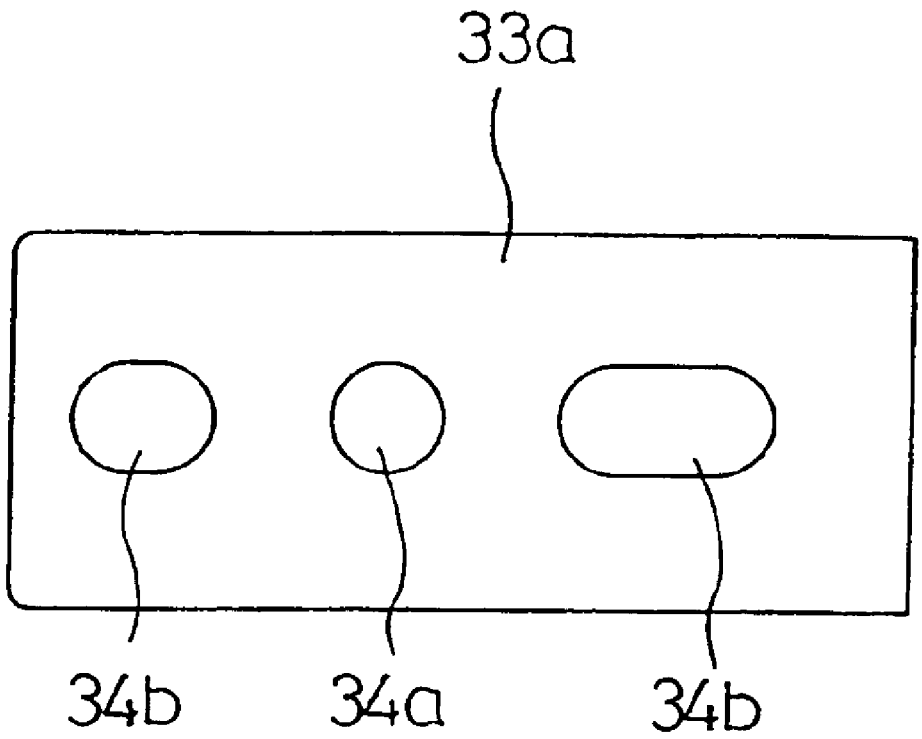
FIG. 18 is a top view of the internal L-shaped segment, one component of a saddle-shaped joining metal member used in combination with the fixing means for fixing the scaffold to the ground.
Figure 19:
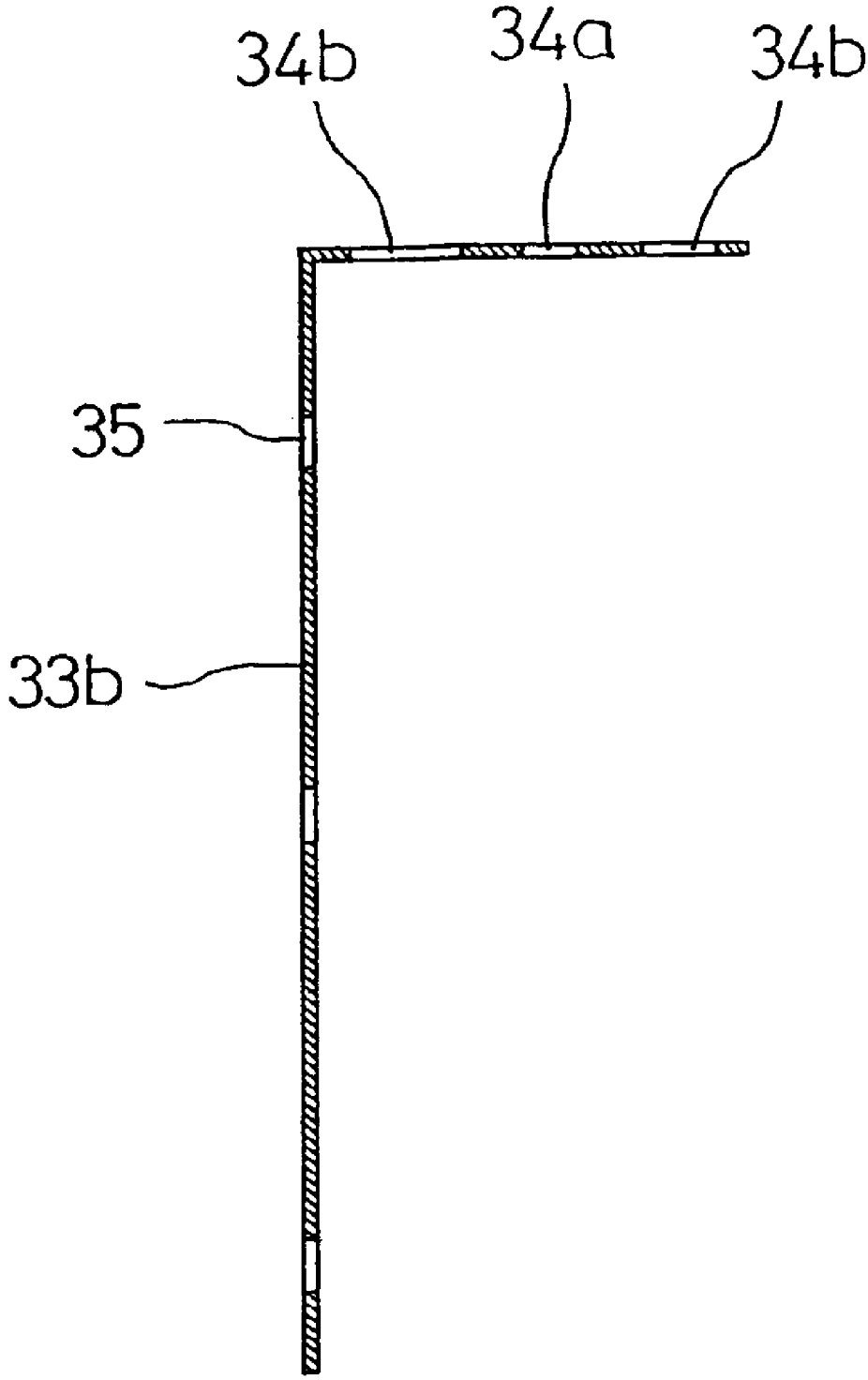
FIG. 19 is a lateral sectional view of an external L-shaped segment, the other component of the saddle-shaped joining metal member used in combination with the fixing means for fixing the scaffold to the ground.
Figure 20:
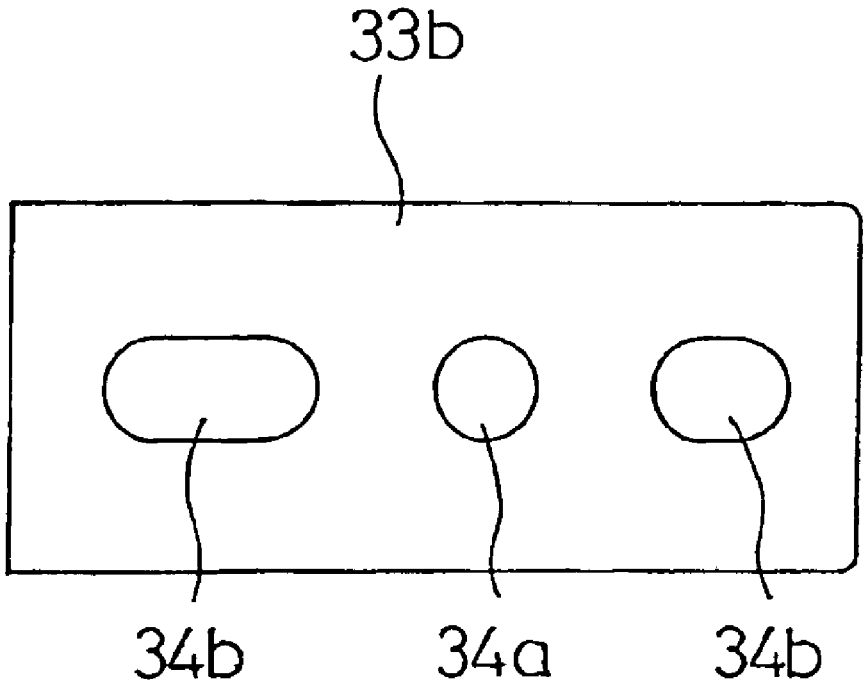
FIG. 20 is a top view of the external L-shaped segment, the other component of the saddle-shaped joining metal member used in combination with the fixing means for fixing the scaffold to the ground.

Each saddle-shaped joining member 33 comprises two segments to be combined with each other with bolts, that is, external L-shaped segment 33*a* as shown in FIGS. 17 and 18, and internal L-shaped segment 33*b*: the external L-shaped segment 33*a* is applied to the outdoor surface of a fence while the internal L-shaped segment 33*b* is applied to the indoor surface of the fence. Each of the L-shaped segment has three holes on its top horizontal arm, that is, a central round hole 34*a* and two ellipsoidal holes 34*b* which are for adjusting the width of the two combined segments and fixing them with each other. Each of the L-shaped segments has holes 35 on its vertical leg for stabilizing the scaffold 5 with respect to the fence.

Stabilizing the scaffold 5 against a concrete block fence 31 using the saddle-shaped metal joining members 33 proceeds as follows. External L-shaped segments 33*a* are attached to the legs of the scaffold body Sa, and internal L-shaped segments 33*b* are mounted over the top of the fence 31. Then, the two horizontal arms of paired L-shaped segments 33*a*, 33*b* are overlapped over the top of the fence 31.

The two horizontal arms of each pair of L-shaped segments 33*a*, 33*b* are overlapped and displaced with respect to each other so as to permit any one or two or more among the plural round and ellipsoidal holes 34*a*, 34*b* of the two overlapped segments to coincide with each other to give one or two or more through holes, and the thus determined length of the overlapped horizontal arms to be as close to the thickness of the fence 31 as possible, and the two L-shaped segments are fixed to each other by screwing bolts into the throughholes. As a consequence, the saddle-shaped joining metal members 33 are fixed onto the fence 31, and thus, the scaffold 5 is stabilized via the saddle-shaped joining members 33 against the concrete block fence 31.

Figure 13:
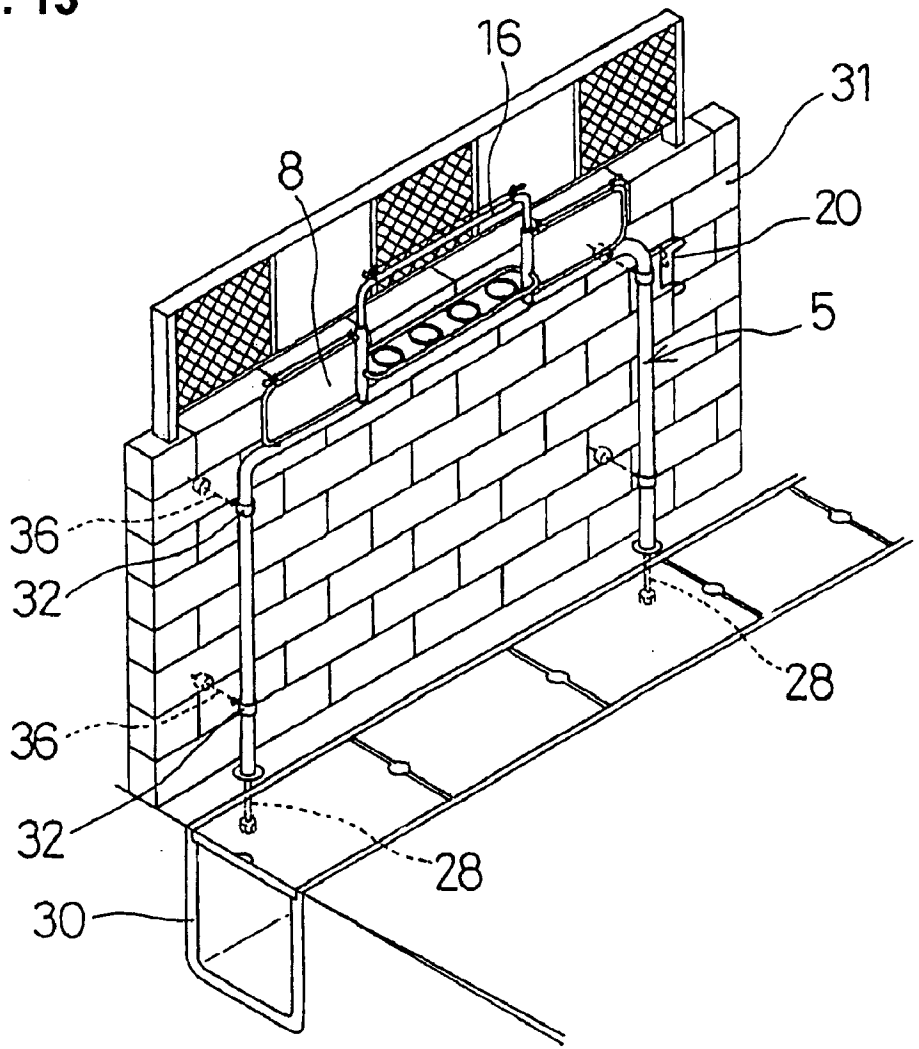
FIG. 13 is a perspective view of the scaffold of the waste collecting box embodying this invention, to show a second exemplary method for fixing the scaffold on the roadside using the fixing means.
Figure 14:
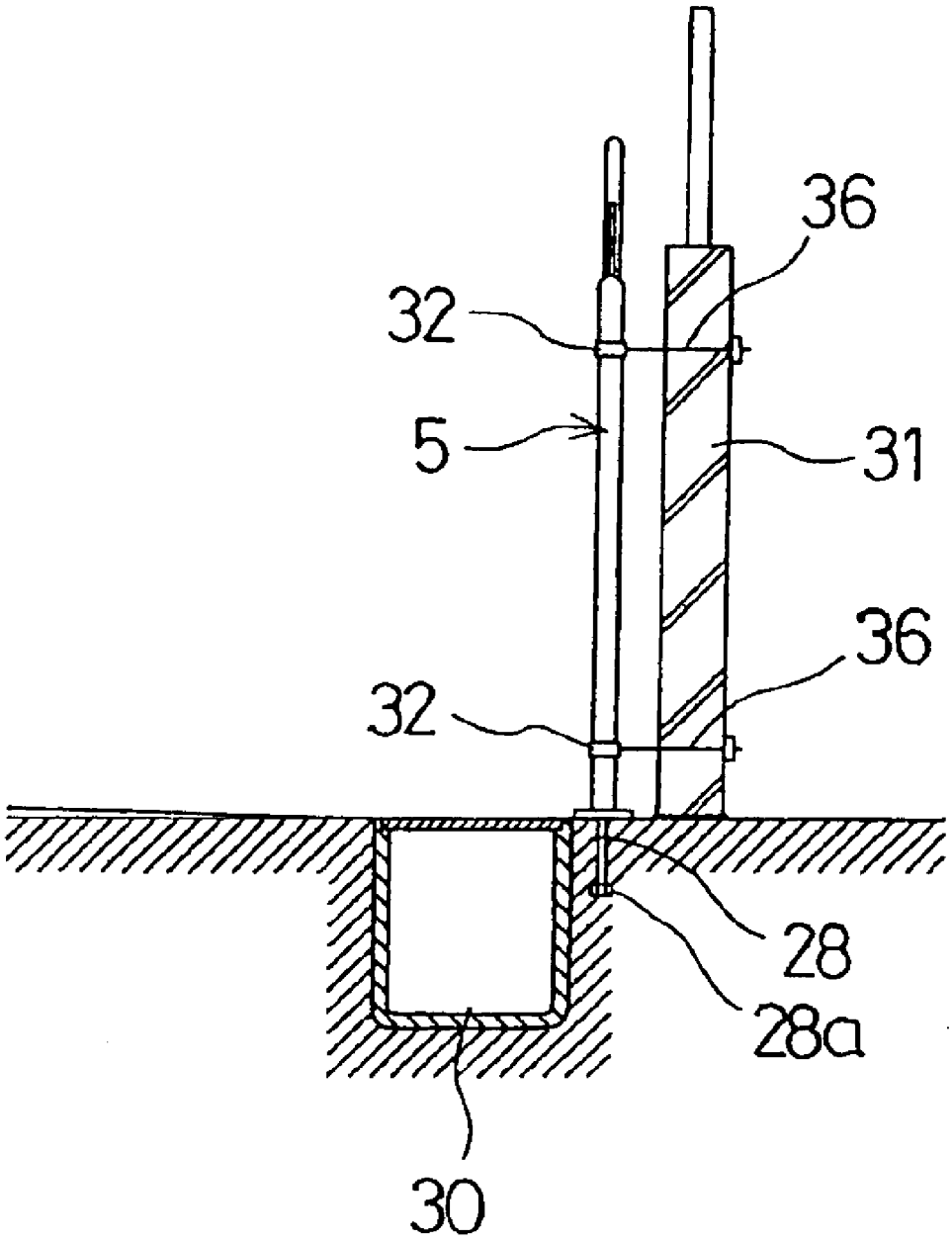
FIG. 14 is a lateral sectional view of the scaffold of the waste collecting box embodying this invention, to show the second method for fixing the scaffold on the roadside using the fixing means.

A second exemplary method for stabilizing the scaffold of a waste collecting box 1 against a concrete block fence 31 is shown in FIGS. 13 and 14. Anchor bolts 36 are inserted through holes penetrating the concrete block fence 31; and metal ring fasteners attached to the legs of the scaffold body 5*a* are fastened to the anchor bolts 36. Each of the anchor bolts 36 has its distal end projected above the indoor surface of the fence 31, and the anchor bolt 36 is fixed with respect to the fence 31 with a nut screwed in from its distal end.

Figure 15:
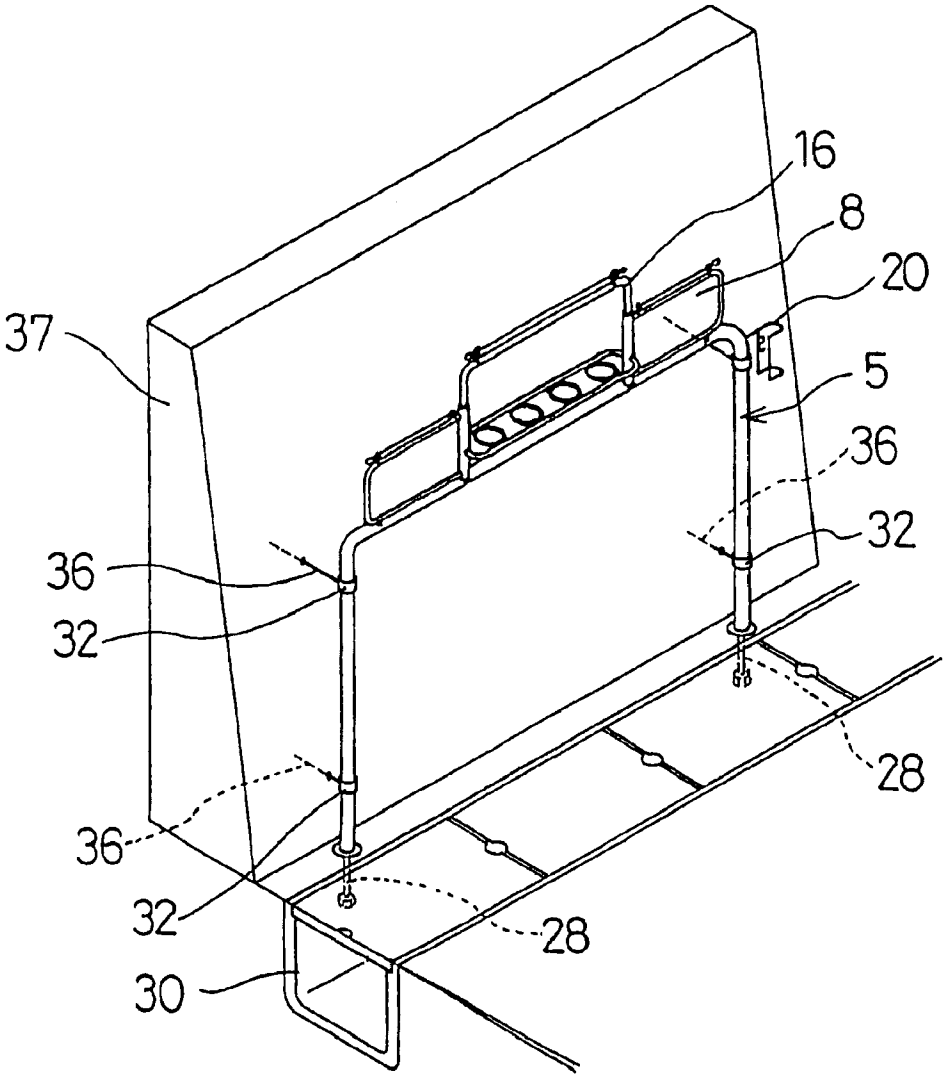
FIG. 15 is a perspective view of the scaffold of the waste collecting box embodying this invention, to show a third exemplary method for fixing the scaffold on the roadside using the fixing means.
Figure 16:
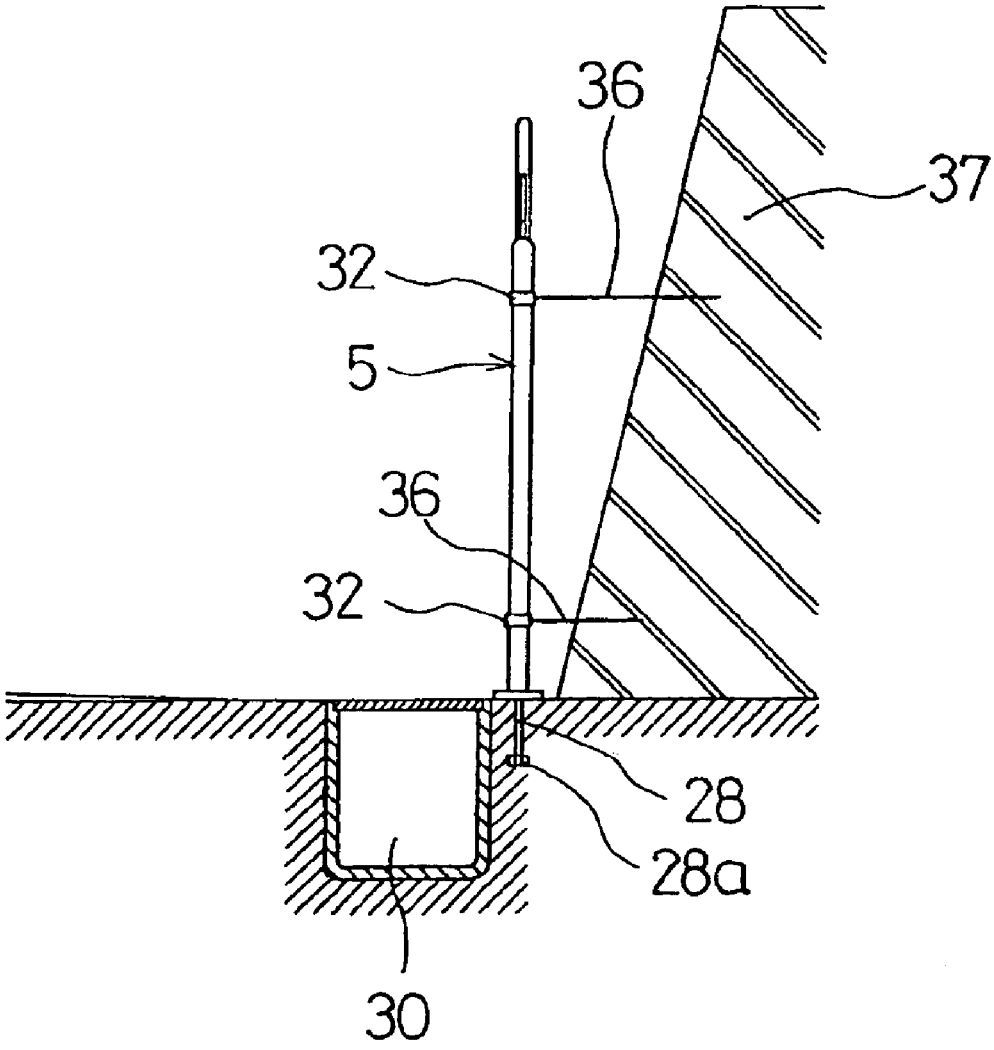
FIG. 16 is a lateral sectional view of the scaffold of the waste collecting box embodying this invention, to show the third method for fixing the scaffold on the roadside using the fixing means.

A third exemplary method for stabilizing the scaffold of a waste collecting box 1 against a wall 37 of a rampart is shown in FIGS. 15 and 16. Anchor bolts 36 are buried into the wall 37, and then metal ring fasteners attached to the legs of the scaffold body 5*a* are fastened to the anchor bolts 36.

As described above, the waste collecting box of the present invention, once it is fixed on the roadside, can be folded into a flat layered structure each time recovery of the waste has been completed for the latest cycle of collection. Therefore, as long as the box is properly folded when not in use, it will not project towards the center of the road during the time at which collection of wastes is not practiced, and thus will not disturb the passage of passengers and motor vehicles through the road. In short, the installment or removal of the waste collecting box of the present invention, and its folding and unfolding after installment are quite easily performed through simple one-touch operations, and the box itself is sufficiently good in appearance that it will not disgrace the scenery of the local area.

What is claimed is:

1. A waste collecting box to be placed on the roadside comprising a rear panel, side panels and a front panel wherein:

each of the side panels comprises two vertical segments, i.e., posterior and anterior segments joined rotatably to a central junction such that the two segments can be folded at the junction with the junction moving inward until the two segments overlap with each other to form a flat structure;

the rear vertical end of the posterior segment of each side panel is jointed rotatably to the lateral vertical end of the rear panel;

the front vertical end of the anterior segment of each side panel is jointed rotatably to the lateral vertical end of the front panel; and wherein the rear panel and the front panel are linked at their centers with a supporting arm which is freely flexible at its center.

2. A waste collecting box to be placed on the roadside comprising a rear panel, side panels and a front panel wherein:

each of the side panels comprises two vertical segments, i.e., posterior and anterior segments joined rotatably to a central junction such that the two segments can be folded at the junction with the junction moving inward until the two segments overlap with each other to form a flat structure;

the rear vertical end of the posterior segment of each side panel is jointed rotatably to the lateral vertical end of the rear panel; and the front vertical end of the anterior segment of each side panel is jointed rotatably to the lateral vertical end of the front panel; and wherein each of the rear and front panels has, at least close to both lateral ends and at the center of its top edge, frame-shaped prop members formed upright to support, when a protective net is applied over the box, the net such that the net can cover the box on the upper portions of its rear, side and front surfaces.

3. A waste collecting box to be placed on the roadside comprising a rear panel, side panels and a front panel wherein:

each of the side panels comprises two vertical segments, i.e., posterior and anterior segments joined rotatably to a central junction such that the two segments can be folded at the junction with the junction moving inward until the two segments overlap with each other to form a flat structure;

the rear vertical end of the posterior segment of each side panel is jointed rotatably to the lateral vertical end of the rear panel; and the front vertical end of the anterior segment of each side panel is jointed rotatably to the lateral vertical end of the front panel; and wherein an inverted U-shaped gate-like scaffold configured to receive the rear panel within its boundaries is stabilized on the roadside, and the rear panel is securely fixed to the scaffold.

4. A waste collecting box as described in claim 3 wherein the scaffold has a shelf for holding flower pots, and a sign board.

5. A waste collecting box described in claim 2 wherein fishing threads are attached to the scaffold and protective net.

6. A waste collecting box as described in claim 3 wherein a hook with a protective mechanism is attached to one leg of the scaffold to hang cleaning devices therefrom.

7. A waste collecting box as described in claim 2 wherein a handle is attached to the top of a prop member located at the center of the top edge of the front panel.

8. A waste collecting box as described in claim 2 wherein cords are freely suspended between the prop members or removed therefrom.

* * * * *